US008636859B2

(12) United States Patent
Larker

(10) Patent No.: US 8,636,859 B2
(45) Date of Patent: Jan. 28, 2014

(54) AUSTEMPERING HEAT TREATMENT DURING HOT ISOSTATIC PRESSING CONDITIONS

(75) Inventor: Richard Larker, Vindeln (SE)

(73) Assignee: Indexator Group AB, Vindeln (SE)

( * ) Notice: Subject to any disclaimer, the term of this patent is extended or adjusted under 35 U.S.C. 154(b) by 32 days.

(21) Appl. No.: 12/995,044

(22) PCT Filed: May 28, 2009

(86) PCT No.: PCT/SE2009/050610
§ 371 (c)(1),
(2), (4) Date: Feb. 10, 2011

(87) PCT Pub. No.: WO2009/145717
PCT Pub. Date: Dec. 3, 2009

(65) Prior Publication Data

US 2011/0120599 A1 May 26, 2011

(30) Foreign Application Priority Data

May 29, 2008 (SE) ..... 0801263

(51) Int. Cl.
*C21D 6/00* (2006.01)

(52) U.S. Cl.
USPC ..... 148/663; 148/579; 148/612; 148/653

(58) Field of Classification Search
USPC ..... 148/320, 579, 612, 653, 663
See application file for complete search history.

(56) References Cited

U.S. PATENT DOCUMENTS

| | | | |
|---|---|---|---|
| 5,522,949 | A | 6/1996 | Widmer et al. |
| 5,849,114 | A | 12/1998 | Keough et al. |
| 2001/0023722 | A1 | 9/2001 | Barone et al. |

FOREIGN PATENT DOCUMENTS

| | | | |
|---|---|---|---|
| JP | 5-148056 | A | 6/1993 |
| JP | 5-195109 | A | 8/1993 |
| JP | 2000-129341 | A | 5/2000 |
| JP | 2005-060760 | A | 3/2005 |
| JP | 2008-050665 | | 3/2008 |

OTHER PUBLICATIONS

"Austempered Ductile-Iron Castings—Advantages, Production, Properties and Specifications" Materials & Design, (1992), vol. 13, No. 5, pp. 285-297, XP009135657.

Hung et al., "The Microstructural Effects on Tensile Properties and Erosion Wear Resistance in Upper Bainitic ADI Related to Variation in Silicon Content" Materials Transactions, (2002), vol. 43, No. 7, pp. 1748-1757, XP009135657.

(Continued)

*Primary Examiner* — Brian Walck
(74) *Attorney, Agent, or Firm* — Buchanan Ingersoll & Rooney PC

(57) ABSTRACT

Method for austempering at least one part of a work piece, which method comprises the steps of: a) heating at least one part of the work piece to an initial austenitizing temperature (T1); b) subjecting said at least one part of the work piece to one or more austenitizing temperatures ($T_1 \ldots T_{1n}$) for a predetermined time to austenitize it; c) quenching said at least one part of the work piece; d) heat treating said at least one part of the work piece at one or more austempering temperatures ($T_2 \ldots T_{2n}$) for a predetermined time to austemper it; e) cooling the at least one part of the work piece; whereby at least one of the steps a) to e) is/are at least partly carried out under Hot Isostatic Pressing (HIP) conditions.

6 Claims, 2 Drawing Sheets

(56) References Cited

OTHER PUBLICATIONS

Supplementary European Search Report dated Dec. 13, 2011, issued in the corresponding European Patent Application No. 09755155.0.
International Search Report (PCT/ISA/210) issued on Sep. 17, 2009, by Swedish Patent Office as the International Searching Authority for International Application No. PCT/SE2009/050610.
Written Opinion (PCT/ISA/237) issued on Sep. 17, 2009, by Swedish Patent Office as the International Searching Authority for International Application No. PCT/SE2009/050610,.
P. D. Fraley et al., "Effects of Hip and Graphite Nodule Count on Tensile Properties of Relatively Pure ADI", AFS Transactions, Transactions of the American Foundrymen's Society, Apr. 23-26, 1995, vol. 103, pp. 445-450.
Office Action dated Jun. 29, 2012 issued by the Japanese Patent Office in Japanese Patent Application No. 2011-511566.

AUSTEMPERING HEAT TREATMENT DURING HOT ISOSTATIC PRESSING CONDITIONS

TECHNICAL FIELD

The present invention concerns a method for austempering at least one part of a work piece. The invention also concerns a work piece at least part of which has been subjected to such a method.

BACKGROUND OF THE INVENTION

In the production of machine parts, castings of iron or steel are frequently used due to their Near-Net-Shape (NNS) capability, reducing the necessary amount of material to be removed by machining, thus promoting Lean Production and reducing both energy consumption and environmental impact. Iron castings containing graphite inclusions with spherical, vermicular or lamellar shapes further improve both the castability and the machinability of the machine parts in comparison to steel castings, and iron castings are therefore preferred if their mechanical properties are sufficient for a particular application. Two main disadvantages with castings, which can result in undesired non-uniformity or scatter in their mechanical properties, are the inherent presence of porosity, at least on a microscopic level, and the segregation of elements in comparison to the equalization in rolled or forged steel, which is particularly detrimental during heat treatments of the castings.

Ductile iron (also called nodular cast iron) is a cast iron that contains carbon in the form of graphite spheroids/nodules. Due to their shape, these small spheroids/nodules of graphite cause less severe stress concentrations in the continuous matrix (actually having a steel composition) compared to the finely dispersed graphite flakes in grey iron, thereby improving strength and in particular ductility as compared with other types of iron.

Austempered ductile iron (ADI) (which is sometimes erroneously referred to as "bainitic ductile iron" represents a special family of ductile iron alloys which possess improved strength and ductility properties as a result of a heat treatment called "austempering". The heat treatment produces a duplex matrix microstructure named "ausferrite" consisting of acicular ferrite precipitated in carbon-stabilized austenite.

ADI castings are, compared to conventional ductile iron, at least twice as strong at the same ductility level, or show at least twice the ductility at the same strength level. Compared to steel castings of the same strength, the cost of casting and heat treatment for ADI is much lower, and simultaneously the machinability is improved, especially if conducted before heat treatment. High-strength ADI cast alloys are therefore increasingly being used as a cost-efficient alternative to welded structures or steel castings, especially since components made from steel are heavier and more expensive to manufacture and to finish than components made from ADI.

Ausferritic steels can be obtained by similar heat treatments as for ausferritic irons, on condition that the steels contain sufficient silicon to prevent the precipitation of carbides. The main difference with respect to irons is that in steel the carbon content is approximately constant in the iron-based matrix, while in irons it can be varied by the selection of the austenitization temperature during heat treatment. One of the rolled steels being suitable for austempering is the spring steel EN 1.5026 with typical composition 0.55 weight-% carbon, 1.8 weight-% silicon and 0.8 weight-% manganese.

The segregation of alloying elements that are added for hardenability is more pronounced in castings than in rolled or forged steel, where the plastic deformation equalizes the compositional variations. It has been shown that when using elements that improve hardenability, such as manganese or molybdenum, the "positive" segregation, (i.e. the segregation that occurs at a late stage during solidification) of larger amounts of these elements in intercellular volumes of cast iron or cast steel, is detrimental for the completion of acicular ferrite precipitation during the formation of ausferrite. The consequence is that austenite in the remaining intercellular volumes, being unaffected by the beneficial enrichment of carbon associated with the precipitation of acicular ferrite, will then not be stabilized against transformation to martensite during the final cooling. Increasing the hardenability by other means than by these additives would therefore be advantageous.

In a typical austempering heat treatment cycle, work pieces comprising iron or steel are firstly heated and then held at an austenitizing temperature until they become fully austenitic. In the case of cast irons, where the graphite inclusions provide a degree of freedom regarding carbon content in the matrix, the austenite must also be given enough time to be saturated with carbon diffusing from the graphite and, if the iron contains pearlite, also with carbon from the dissolution of its cementite. After the work pieces are fully austenitized, they are quenched (usually in a salt bath) at a quenching rate that is high enough to avoid the formation of pearlite during the quenching down to an intermediate temperature above the temperature $M_s$, at which the austenite having this level of carbon would otherwise start to transform into martensite. This intermediate temperature range is better known as the bainitic range for common low-silicon steels, and in a similar way the ausferritic microstructure becomes either coarser for higher transformation temperatures, but here with a larger amount of austenite (promoting higher ductility), or finer for lower temperatures with a larger amount of ferrite (enabling higher strength). The work pieces are then held for isothermal transformation to ausferrite at this temperature called the austempering temperature, followed by cooling to room temperature.

The superior mechanical properties of ausferritic materials emanate from an ausferritic microstructure of very fine needles of acicular ferrite in a matrix of austenite, thermodynamically stabilized by the concurrent enrichment of carbon to a high carbon content. The much higher silicon content in austempered ductile irons, compared to common steels, stabilizes carbon in graphite instead of cementite ($Fe_3C$), thus preventing the precipitation of bainitic carbides as long as the austempering is not too prolonged.

U.S. Pat. No. 5,522,949 discloses a method for improving the mechanical properties, such as tensile strength, yield strength and fracture elongation of a ductile iron, by subjecting the ductile iron to Hot Isostatic Pressing before it is subjected to a conventional austempering treatment.

Hot Isostatic Pressing (HIP) is a process that is used to reduce the porosity of metals and to influence the density of ceramic materials. The HIP process subjects a work piece to both elevated temperature and isostatic gas pressure (whereby pressure is applied to the material from all directions) in a high pressure containment vessel. An inert gas such as argon is usually used to prevent chemical reactions, and the pressurizing gas is usually raised to a pressure level between 100-300 MPa by a combination of pumping and electrical heating of the gas surrounding the work pieces. When materials are treated with HIP, the simultaneous application of heat and pressure eliminates internal (closed) voids and microporosity through a combination of plastic deformation, creep, and diffusion bonding.

While resulting in the production of austempered material having improved mechanical properties, the use of Hot Isostatic Pressing before a conventional austempering treatment substantially increases manufacturing time and costs.

SUMMARY OF THE INVENTION

An object of the present invention is to provide an improved method for austempering at least one part of a work piece.

The object is achieved by a method comprising the steps of:

a) heating at least one part of the work piece to an initial austenitizing temperature ($T_1$);

b) subjecting said at least one part of the work piece to one or more austenitizing temperatures ($T_1 \ldots T_{1n}$) for a predetermined time to austenitize it, i.e. substantially holding it at one austenitizing temperature or a plurality of consecutive austenitizing temperatures or varying the austenitizing temperature;

c) quenching said at least one part of the work piece;

d) heat treating said at least one part of the work piece at one or more austempering temperatures ($T_2 \ldots T_{2n}$) for a predetermined time to austemper it, i.e. substantially holding it at one austempering temperature or a plurality of consecutive austempering temperatures or varying the austempering temperature; and e) cooling the at least one part of the work piece;

whereby at least one of the steps a) to e) is/are at least partly carried out under Hot Isostatic Pressing (HIP) conditions, i.e. under high isostatic pressure (for example using an inert gas, such as argon, at a pressure of 100-300 MPa).

The expression "predetermined time" in steps b) and d) is intended to mean time(s) sufficient to heat the entire work piece or the part(s) thereof that is/are to be austenitized up to the austenitizing temperature and to saturate the austenite with carbon, or to allow acicular ferrite to grow and enrich the surrounding austenite with carbon, respectively, to produce an ausferritic structure.

A method according to the present invention reduces the processing time and improves the mechanical properties of the at least one part of the work piece, due to the improved heat transfer by the pressurized gas combined with an increased rate of transformation into austenite during the austenitizing step, and through the delaying effect of the high isostatic pressure on any detrimental transformations of austenite during the rapid cooling from austenitization to austempering temperature during the quenching step.

When the austempering temperature has been reached throughout the at least one part of the work piece after quenching, the isostatic pressure may then be decreased in order to increase the rate of acicular ferrite precipitation during the isothermal transformation into ausferrite, or the isostatic pressure may be maintained (during at least part of the austempering step d)), in order to slow down the rate of acicular ferrite precipitation.

It should be noted that preferably all of the steps a) to e) are carried under HIP conditions. However, not all of the steps need necessarily be carried out under HIP conditions, but the most benefits from HIP are gained during steps b) and c), while the at least part of the work piece can be at least partly preheated in another furnace in step a), and the isothermal transformation in step d) may take place in another furnace or salt bath.

The prior art does not disclose an austempering method in which an elimination of porosity and/or residual stresses in irons or steels is achieved in combination with an austenitization and/or quenching and/or austempering under high isostatic pressure, using Hot Isostatic Pressing. The present invention is based on the realization that an improvement in hardenability is possible by carrying out at least one of steps a), b) and/or c) under Hot Isostatic Pressing (HIP) conditions (high gas pressure).

While not wishing to be bound by any theory, it would seem that the gamma field for close-packed austenite expands only slightly at higher isostatic pressures, so that the temperatures for transformations on cooling to ferrite, pearlite and martensite are decreased by about 5-10 K for a typical HIP pressure of 200 MPa. The kinetic influence is however much larger on transformations between austenite and other phases (pearlite, ferrite, bainite, martensite and various carbides) in irons and steels. This can be utilized both by shortening the hold time necessary at austenitizing temperature, and by a considerable increase in hardenability, since other phases like ferrite and pearlite have specific volumes that are more than three percent larger, thus stabilizing the close-packed austenite during austenitization and cooling. At 200 MPa, the hardenability becomes approximately doubled, thus either allowing a 50% increase of hardenable cross-section for an unchanged alloy composition, or allowing a decrease of expensive alloying elements by for example −0.50 weight-% nickel or −0.12 weight-% molybdenum, thereby both decreasing alloying cost and facilitating the completion of ausferrite formation.

Furthermore, the cooling rate in 200 MPa of an inert gas such as argon (with a viscosity resembling water at this pressure) can be increased further by utilizing improved heat exchangers and fans within the pressure chamber in which the method according to the invention is carried out. This enables even larger cross-sections of a work piece to be cooled without pearlite formation in the core but, since the at least one part of the work piece is within a firm isostatic grip, its macroscopical shape is still preserved, and such high cooling rates will therefore not result in large residual stresses or warpage.

The method according to the present invention therefore provides a cost-effective way of obtaining ausferritic material with superior properties. The use of Hot Isostatic Pressing (HIP) reduces the requirement of hardenability-increasing alloying additions, which is beneficial for decreasing both compositional segregation and alloying cost. Additionally, improved strength and ductility with reduced scatter may be obtained due to the elimination of all closed porosity in the at least one part of the work piece. Further, the method offers the possibility of manufacturing work pieces with closer machining tolerances since residual stresses are eliminated from the work piece, and batch-processing time may be decreased.

If quenching step c) is carried out under HIP conditions a rapid cooling (greater or equal to than 150 K/min) exceeding the rate of quenching in oils or salt baths is possible, since the pressurized gas provides efficient heat transfer.

According to an embodiment of the invention the at least one part of the work piece comprises one of the following: an alloyed or un-alloyed ductile iron, another cast iron or cast steel, rolled or wrought steel, or steel with a silicon content of 1.0 weight-% or more. The expression "un-alloyed" is intended to mean that no copper, nickel or molybdenum has been added to the ductile iron, i.e. the composition of the ductile iron comprises a maximum of 0.1 weight-% of Cu or Ni and a maximum of 0.01 weight-% of Mo.

According to another embodiment of the invention the at least one part of the work piece may comprise max 0.5 weight-% of aluminium.

Another possibility to minimise the adverse affect of hardenability increasing additives to cast irons or cast steels, is to increase the amounts of different elements that slow down the kinetics of the austenite-to-pearlite transformation during cooling, but have segregated "negatively" (i.e. solidified at an early stage during the solidification and thus enriched around the carbon precipitates in irons). Two elements fulfilling these requirements are silicon and aluminium. In contrast, molybdenum segregates positively and also contributes to the precipitation of carbides. Manganese is even more detrimental since it, apart from segregating positively and promoting the formation of iron carbides, also at higher concentrations prevents the completion of the isothermal conversion to ausferrite.

The versatility of silicon and/or aluminium as hardenability promoters for austempering has not received much attention. In cast irons, silicon levels of at least two percent in the ternary Fe—C—Si system are necessary to promote grey solidification resulting in graphite inclusions. The increased silicon level further delays or completely prevents the formation of embrittling bainite (ferrite+cementite $Fe_3C$) during austempering, thereby allowing complete isothermal transformation to ausferrite. Higher levels of silicon, such as 1.0 weight-% or more in steel or 3.35 weight-% or more in ductile iron, possibly together with additions of aluminium, may therefore provide several benefits in ausferritic materials.

According to an embodiment of the invention, in step c) said at least one part of the work piece is quenched to one of said one or more austempering temperatures ($T_2 \ldots T_{2n}$). The at least one part of the work piece may however be quenched to a temperature being initially below the lowest of said one or more austempering temperatures ($T_2 \ldots T_{2n}$).

According to further embodiment of the invention, in step c) the at least one part of the work piece is quenched at a quenching rate sufficient to prevent the formation of pearlite, such as at least 150 K/min.

The present invention also concerns a work piece, at least one part of which has been subjected to a method according to any of the embodiments of the invention. The at least one part of the work piece comprises austempered material having an improved combination of high strength, ductility and hardness. Such a work piece is intended for use particularly, but not exclusively, in mining, construction, agriculture, earth moving, manufacturing industries, the railroad industry, the automobile industry, the forestry industry, in applications where high wear resistance is required or in applications in which strict specifications must be met consistently.

The present invention further concerns the use of Hot Isostatic Pressing (HIP) to increase the hardenability of at least one part of a work piece.

BRIEF DESCRIPTION OF THE DRAWINGS

The present invention will hereinafter be further explained by means of non-limiting examples with reference to the appended figures where FIG. 1 schematically shows an austempering method according to an embodiment of the invention, and FIG. 2 schematically shows a Hot Isostatic Press.

DETAILED DESCRIPTION OF EMBODIMENTS

Figure 1:
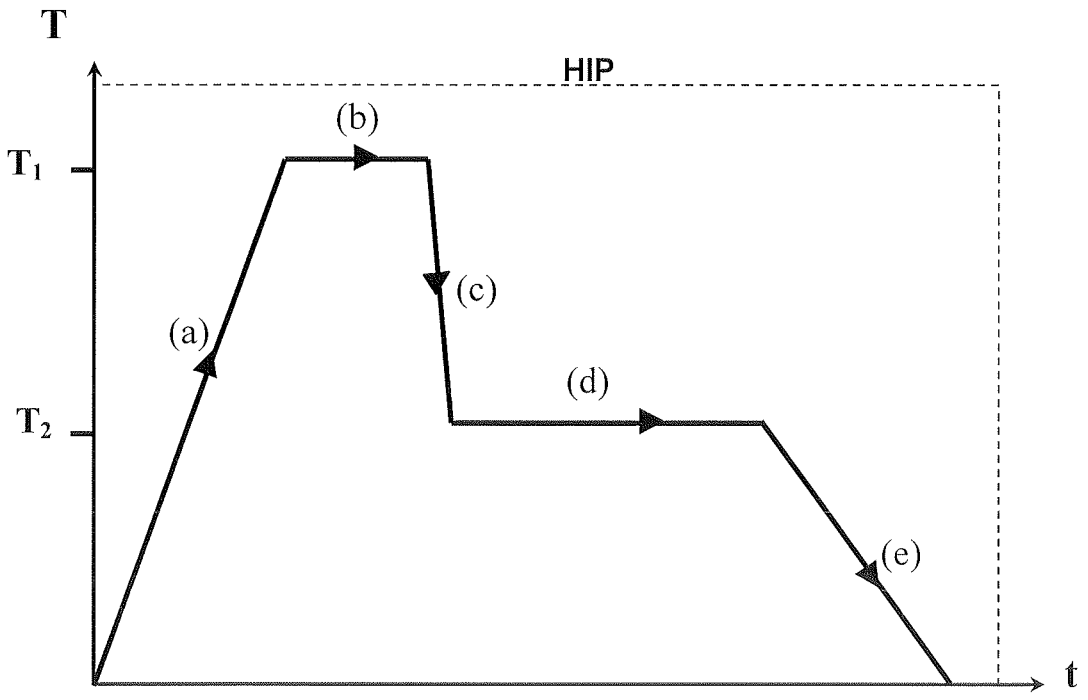

FIG. 1 shows an austempering heat treatment cycle according to an embodiment of the invention. A whole work piece is in step a) heated under HIP conditions to an initial austenitizing temperature $T_1$. The work piece is in step b) held at that initial austenitizing temperature $T_1$ for a predetermined time until the work piece becomes fully austenitic and the matrix becomes saturated with carbon. The work piece may for example be a suspension or power train-related component for use in a heavy goods vehicle, such as a spring hanger, bracket, wheel hub, brake calliper, timing gear, cam, camshaft, annular gear, clutch collar or pulley.

After the work piece is fully austenitized, it is quenched at a high quenching rate [step c)], such as 150 K/min or higher under HIP conditions. The work piece is then held at an austempering temperature $T_2$ [step (d)], optionally under HIP conditions (high gas pressure) for at least part of the holding time. After isothermal austempering, the work piece is cooled to room temperature [step (e)]. The work piece may then be used in any application in which it is likely to be subjected to stress, strain, impact and/or wear under operation.

Furthermore, the work piece may be machined, preferably before the heating step a) until the desired final dimensions, if compensated for the forecasted volume changes during transformation to ausferrite. It is namely favourable to carry out as much of the necessary machining of the work piece as possible before the austempering treatment. Alternatively or additionally, the work piece may be machined after the austempering is completed [step e)], for example, if some particular surface treatment is required.

Carrying out the heating step a) under HIP conditions accelerates the heating rate. Carrying out the austenitizing step b) under HIP conditions accelerates the austenitization. Carrying out the quenching step c) under HIP conditions accelerates the cooling rate and concurrently increases the hardenability of the work piece, thus either allowing increased hardenable dimensions or allowing for a decrease in alloying additions such as nickel and molybdenum.

Carrying out the austempering step d) under HIP conditions makes it possible to decrease the rate of acicular ferrite precipitation, if desired.

HIP during any of the steps a) to e) [in particular step b) and c)] also results in the following well-known advantages: elimination of porosity, elimination of residual stresses, consistent material properties and machining properties.

EXAMPLE

A work piece comprising ductile iron having one of the following compositions in weight-%:

| | |
|---|---|
| C | 3.0-3.6 |
| Si | 3.35-4.60 |
| Mn | max 0.4 |
| P | max 0.05 |
| S | max 0.02 |
| Cu | max 0.1 |
| Ni | max 0.1 |
| Mo | max 0.01 |

optionally Al max 1.0, preferably max 0.5 weight-% aluminium,
balance Fe and normally occurring impurities.
or:

| | |
|---|---|
| C | 3.0-3.6 |
| Si | 3.35-4.60 |

-continued

| | |
|---|---|
| Mn | max 0.4 |
| P | max 0.05 |
| S | max 0.02 |
| Cu | max 0.8 |
| Ni | max 2.0 |
| Mo | max 0.3 |

optionally Al max 1.0, preferably max 0.5 weight-% aluminium, balance Fe and normally occurring impurities.

The ductile iron may be heated in a Hot Isostatic Press to a temperature of at least 910° C. in step a); held at that temperature for a predetermined time of 30 minutes to two hours in step b); quenched at 150 K/min in step c); austempered at a temperature between 250-400° C., preferably 350-380° C., and held at that temperature for a predetermined time, such as 30 minutes to two hours in step d), before being cooled to room temperature in step e). All of the steps a) to e) are namely carried out under HIP conditions, for example using argon gas at a pressure of 100-300 MPa.

Such an ADI work piece offers a highly advantageous combination of low total cost, high strength-to-weight ratio, good ductility, wear resistance, fatigue strength and improved machinability, as well as all of the production advantages of conventional ductile iron castings. This ADI has mechanical properties that are superior to conventional ADI having a silicon content of about 2.50%±0.20%, as well as to conventional ductile iron, cast and forged aluminum and several cast or forged steels. It is also 10% less dense than steel.

The base composition also exhibits significantly better machinability due to the ferritic structure that is solution-strengthened by silicon. Conventional pearlitic and ferritic-pearlitic microstructures are more abrasive on tools and exhibit substantial variations in strength and hardness throughout the microstructure thereof, which makes it very difficult to optimize machining parameters and to achieve narrow geometric tolerances.

The increased silicon level further delays or completely prevents the formation of embrittling bainite (ferrite+cementite $Fe_3C$), thereby allowing complete isothermal transformation to ausferrite (acicular ferrite in a matrix of ductile austenite, thermodynamically stabilized by a high carbon level) during austempering. The ADI also provides improvements in both strength and ductility compared to conventional ADI having a silicon content of 2.3-2.7 weight-%, due to the reduced segregation of mainly manganese and molybdenum and to the avoidance of the formation of embrittling carbides.

Figure 2:
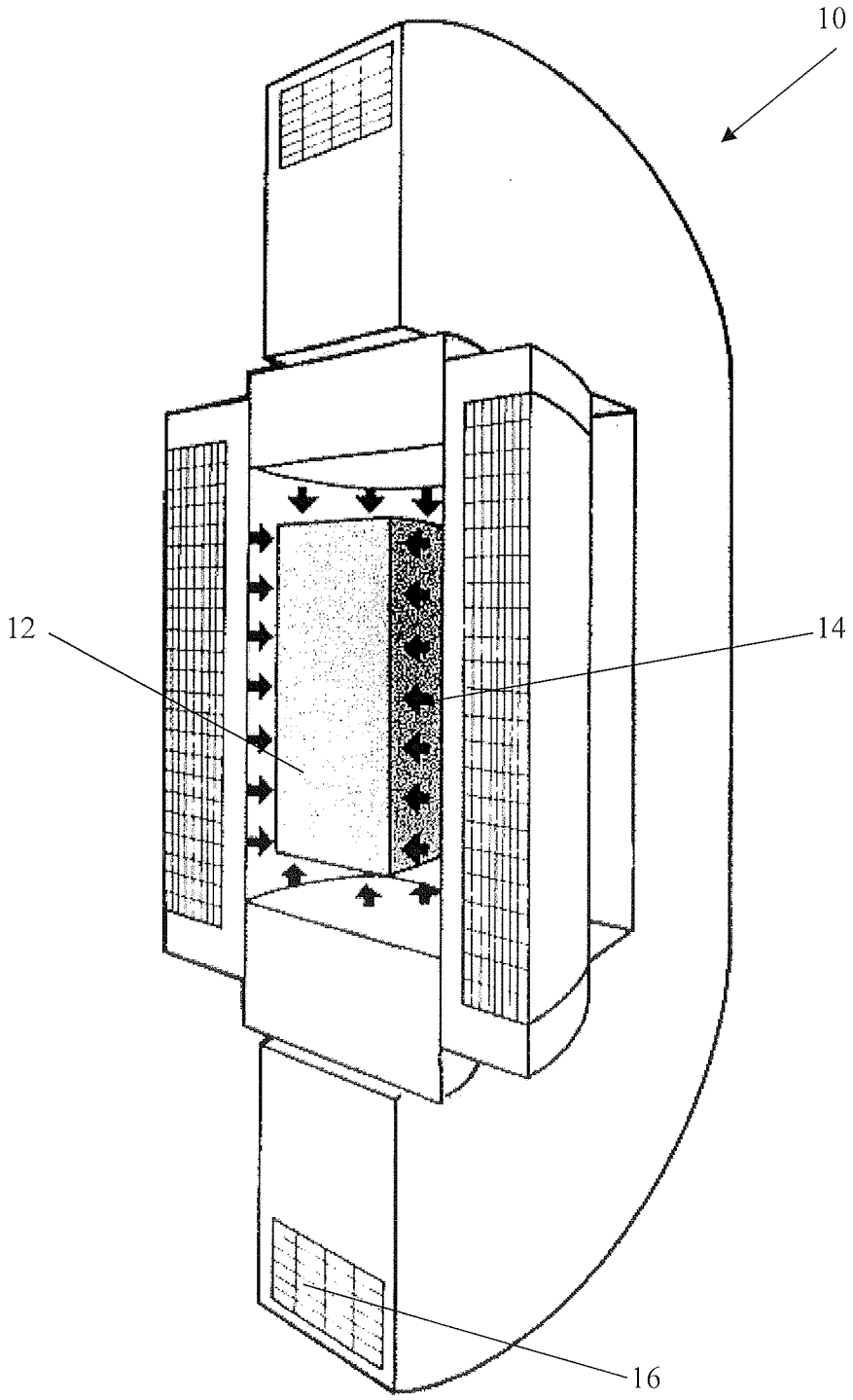

FIG. 2 shows a Hot Isostatic Press 10 in which one work piece 12 is subjected to a method according to an embodiment of the invention. It should be noted that one or more work pieces may be placed inside the Hot Isostatic Press 10 and that the work piece(s) can be of any shape and size as long as it/they can fit inside the Hot Isostatic Press 10. The work piece 12 is radially and axially outwards surrounded firstly by a pressurized gas 14 acting normally at all surfaces, secondly by furnace walls, thirdly by a heat insulating mantle and fourthly by the water-cooled pressure vessel walls, being held in compression by pre-stressed wire windings 16.

All of the surfaces of the work piece 12 (as well as all of the surfaces of the furnace and the heat insulating mantle and the internal surfaces of the pressure vessel) are subjected to high-pressure inert gas 14, such as argon at a pressure of 200 MPa.

The invention claimed is:

1. A method for austempering a work piece, which method consists of the steps of:

a) heating the work piece to one or more austenitizing temperatures ($T_1 \ldots T_{1n}$) for a predetermined time to austenitize it, b) quenching the work piece to an austemperinq temperature, c) heat treating the work piece at one or more austempering temperatures ($T_2 \ldots T_{2n}$) for a predetermined time to austemper it, and d) cooling the work piece, wherein at least steps a) and b) are carried out under Hot Isostatic Pressing conditions.

2. A method according to claim 1, wherein the work piece comprises one of the following: an alloyed or un-alloyed ductile iron, cast iron or cast steel, rolled or wrought steel, or steel with a silicon content of 1.0 weight-% or more.

3. A method according to claim 2, wherein in step b) the work piece is quenched at a quenching rate sufficient to prevent the formation of pearlite.

4. A method according to claim 3, wherein the quenching rate is at least 150 K/min.

5. A method according to claim 1, wherein in step b) the work piece is quenched at a quenching rate sufficient to prevent the formation of pearlite.

6. A method according to claim 5, wherein the quenching rate is at least 150 K/min.

* * * * *